US007617760B2

(12) United States Patent
Kraft

(10) Patent No.: US 7,617,760 B2
(45) Date of Patent: Nov. 17, 2009

(54) VALVE DEVICE

(75) Inventor: Wolfgang Kraft, Ringheim (DE)

(73) Assignee: Linde Material Handling GmbH, Aschaffenburg (DE)

( * ) Notice: Subject to any disclaimer, the term of this patent is extended or adjusted under 35 U.S.C. 154(b) by 308 days.

(21) Appl. No.: 11/637,212

(22) Filed: Dec. 11, 2006

(65) Prior Publication Data

US 2007/0151442 A1 Jul. 5, 2007

(30) Foreign Application Priority Data

Dec. 12, 2005 (DE) ..... 10 2005 059 239

(51) Int. Cl.
*F15B 11/024* (2006.01)

(52) U.S. Cl. ..... 91/436; 91/447

(58) Field of Classification Search ..... 91/436, 91/437, 447

See application file for complete search history.

(56) References Cited

U.S. PATENT DOCUMENTS 3,477,347 A * 11/1969 Rice ..... 91/437
3,630,121 A * 12/1971 Landaeus et al. ..... 91/437
5,065,664 A * 11/1991 Ohta et al. ..... 91/436
5,996,465 A * 12/1999 Morikawa et al. ..... 91/436

FOREIGN PATENT DOCUMENTS

DE 198 44 669 A1 3/2000

* cited by examiner

*Primary Examiner*—F. Daniel Lopez
(74) *Attorney, Agent, or Firm*—The Webb Law Firm

(57) ABSTRACT

A control valve device (1) for the control of a consumer (2), in particular of a dual-action consumer, includes a control valve (3) that controls the connection of an admission side of the consumer (2) with a pump and a return side of the consumer (2) with a reservoir. The control valve device (1) has a regeneration function by means of which the return side of the consumer (2) can be connected with the admission side of the consumer (2). The regeneration function has a short circuit device (10) located between the consumer (2) and the control valve (3) and provides a connection of the return side of the consumer (2) with the admission side of the consumer (2). For the regeneration function, the connection of the return side of the consumer (2) with the reservoir can be shut off by the control valve (3).

15 Claims, 1 Drawing Sheet

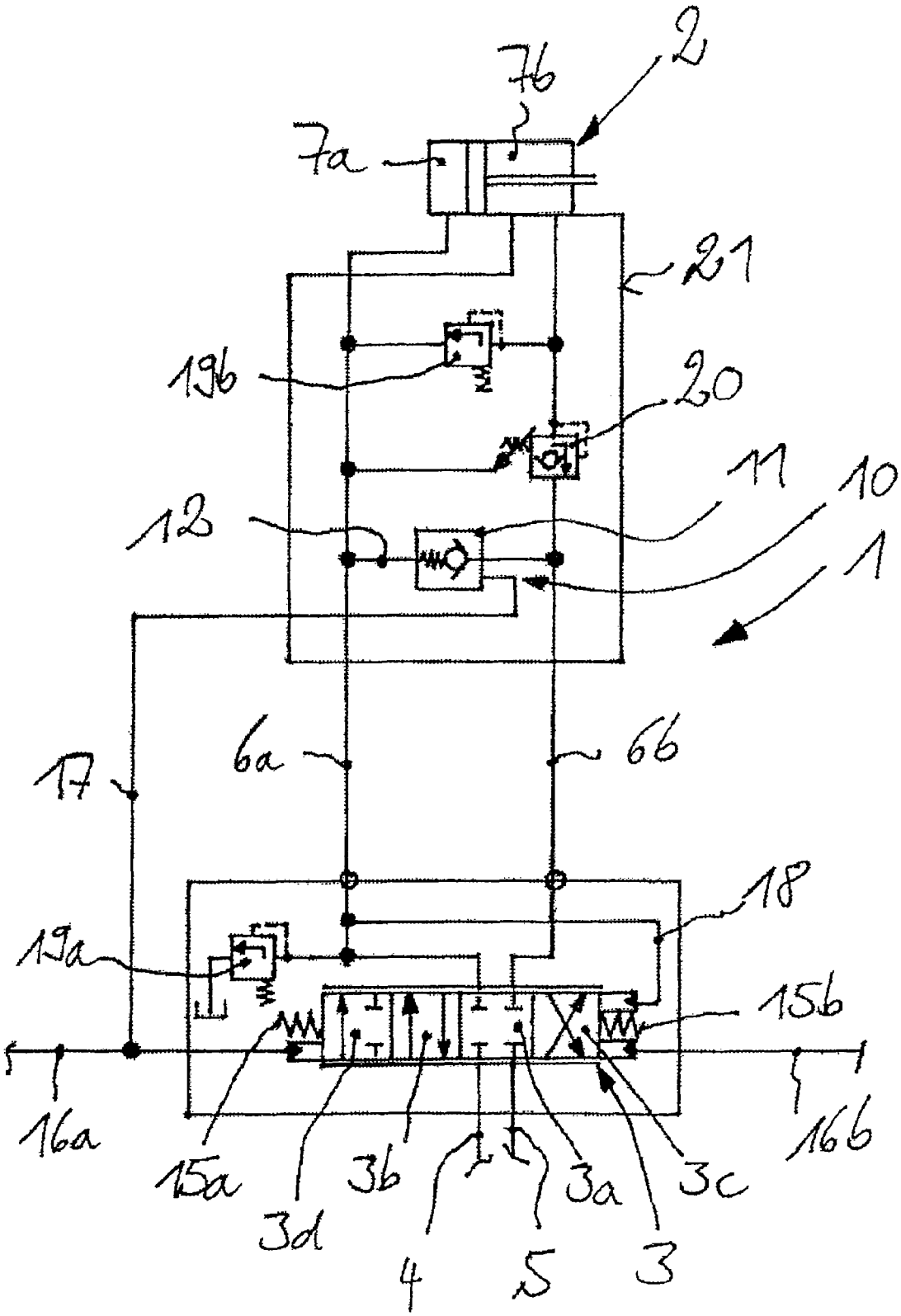
2
7b
7a
21
19b
20
11
10
12
1
17
6a
6b
18
19a
15b
16a
16b
15a
3b
3a
3c
3d
4
5
3

VALVE DEVICE

CROSS REFERENCE TO RELATED APPLICATION

This application claims priority to German Application No. 10 2005 059 239.2, filed Dec. 12, 2005, which application is herein incorporated by reference in its entirety.

BACKGROUND OF THE INVENTION

1. Field of the Invention

This invention relates to a control valve device for the control of a consumer, such as a dual-action consumer. The control valve device includes a control valve that controls the connection of an admission side of the consumer with a pump and a return side of the consumer with a reservoir. The control valve device also has a regeneration function, by means of which the return side of the consumer can be connected with the admission side of the consumer.

2. Technical Considerations

Control valve devices are used for the control of consumers in mobile machines, for example to control a stick cylinder of an excavator. To prevent cavitation on the admission side of the consumer and to achieve an increased speed of movement of the consumer (which requires a flow that exceeds the discharge flow delivered by the pump), conventional control valve devices are provided with a regeneration function. The regeneration function connects the return side of the consumer with the admission side. As a result of which, on the admission side of the consumer, the flow of pressure fluid flowing out of the return side of the consumer is available in addition to the discharge flow delivered by the pump.

A control valve device is described in DE 198 44 699 A1. The regeneration function is formed by regeneration lines, each of which connects a return line that leads from the control valve to the reservoir with the respective admission side of the consumer. Check valves that open to the admission side of the consumer are located in these regeneration lines. For the regeneration function, the return line is shut off by means of a valve device that is located in the return line downstream of the connections of the regeneration lines. When the regeneration function is active, the pressure fluid that is being discharged from the return side of the consumer flows via the control valve and the return line (which is shut off by means of the valve device) into the regeneration line which is in communication with the admission side of the consumer and thus to the admission side of the consumer. However, as a result of this routing of the flow of pressure fluid of the regeneration function via the control valve, long flow paths are required. This leads to high line losses and requires a great deal of construction effort and expense. The valve device is also necessary for the shutoff of the return line that leads from the control valve to the reservoir, which leads to a further increase in the construction effort and expense for the control valve device.

Therefore, it is an object of this invention to provide a control valve device of the general type described above but which has a regeneration function with low line losses and requires less construction effort and expense than known devices.

SUMMARY OF THE INVENTION

The invention teaches that the regeneration function has a short circuit device located between the consumer and the control valve, which makes it possible to connect the return side of the consumer with the admission side of the consumer. For the regeneration function, the connection between the return side of the consumer and the reservoir can be shut off by means of the control valve. The invention therefore teaches a short circuit device located between the consumer and the control valve, and connects the return side with the admission side of the consumer for the regeneration function. The invention further teaches that the connection of the return side of the consumer with the reservoir can be shut off by the control valve for the regeneration function. When the regeneration function is active, the connection of the return line with the reservoir is shut off by the control valve, whereby the pressure fluid being discharged from the return side of the consumer flows via the short circuit device, bypassing the control valve, directly into the admission side of the consumer. Consequently, for the regeneration function, a short flow path of the pressure fluid from the return side to the admission side of the consumer can be achieved. As a result of which, the line losses are low and a simple routing of the respective conduits can be achieved with little construction effort and expense. As a result of the shutoff of the connection between the return side of the consumer and the reservoir by the control valve, in contrast to a conventional control valve device, no additional valve device located in the return line leading from the control valve to the reservoir is necessary and, consequently, a control valve of the invention requires little construction effort and expense.

In one embodiment of the invention, the control valve is provided with a regeneration position in which the admission side of the consumer is in communication with the pump and the connection of the return side of the consumer with the reservoir is shut off. With an additional regeneration position of this type, the control valve can shut off the return side of the consumer in a simple manner for the regeneration function.

It is particularly advantageous if the control valve can be actuated by a control signal toward a position that connects the admission side of the consumer with the pump and connects the return side of the consumer with the reservoir, whereby the control valve can be actuated from the normal position toward the regeneration position in response to an increasing control signal. This measure makes it easily possible to move the control valve from the normal position into the regeneration as the control signal increases. The flow of pressure fluid that is discharged from the return side of the consumer can thus be built up above a specifiable control signal by actuating the control valve into the regeneration position and can be made to flow via the short circuit device to the admission side of the consumer. As a result of which, the regeneration function can be easily switched to achieve an increased speed of movement of the consumer as a function of the control signal of the control valve.

In one embodiment of the invention, the short circuit device is in the form of a short circuit valve with a shutoff position and an open position that can be activated into the open position for the regeneration function. For the regeneration function, a connection of the return side of the consumer with the admission side can be created in a simple manner with a short circuit valve of this type.

For the regeneration function, the short circuit valve can be actuated into the open position by the control signal that actuates the control valve into the regeneration position. With the control signal of the control valve that actuates the control valve toward the regeneration position, the short circuit valve can be actuated in a simple manner from the shutoff position into the open position for the regeneration function.

The short circuit valve can be realized in the form of a slide valve with an open position and a shutoff position, and can be actuated toward the shutoff position by means of a spring and toward the open position by the control signal of the control valve.

With regard to a simple construction that requires little effort and expense, it is advantageous if the short circuit valve is a seat valve that opens toward the admission side of the consumer. In one embodiment, the short circuit valve includes a spring-loaded check valve that can be actuated into the open position by the control signal that actuates the control valve toward the regeneration position.

In one development of the invention, the regeneration function can be overridden as a function of the admission pressure that is available on the admission side of the consumer. Under operating conditions in which a high admission pressure at the consumer is necessary to achieve high power or increased performance, the regeneration function can thus be deactivated in a simple manner by the overriding of the regeneration function as a function of the admission pressure. By means of the overriding of the regeneration function as a function of the admission pressure, it thereby becomes possible in a simple manner to ensure that the regeneration function is active only to achieve an increased speed of movement of the consumer.

The regeneration function can be overridden in a simple manner as a function of the admission pressure of the consumer if the control valve can be actuated from the regeneration position toward the normal position by the admission pressure that is available on the admission side of the consumer. Consequently, under operating conditions in which high admission pressures are required on the admission side of the consumer, it becomes easily possible to connect the return side of the consumer with the reservoir and thus to deactivate the regeneration function by actuating the control valve into the normal position.

It is advantageous if the control valve is thereby provided with a control surface that is in communication with the admission side and counteracts the control signal. For the overriding of the regeneration function, the control valve can be actuated into the normal position in a simple manner by the connection of the pressure available on the admission side to a control surface that counteracts the control signal that actuates the control valve toward the normal position and the regeneration position.

It is also possible, for overriding the regeneration function, to reduce the control signal that actuates the control valve as a function of the admission pressure. As a result of which, the control valve can likewise be actuated into the normal position in a simple manner for the overriding of the regeneration function.

A simple construction can be achieved if, as in one embodiment of the invention, a first pressure fluid line is connected to the control valve and is in communication with the admission side of the consumer, and a second pressure fluid line is connected to the control valve and is in communication with the return side of the consumer, with the short circuit device located in a pressure fluid line that connects the first pressure fluid line with the second pressure fluid line.

With regard to low power losses and a short flow path of the pressure fluid that flows from the return side to the admission side for the regeneration function, it is advantageous if the short circuit device is located on the consumer. As a result of the regeneration device formed by the short circuit device and the control valve, the short circuit device can be located separately from the control valve in a simple manner directly on the return side of the consumer, as a result of which low line losses can be achieved.

If, as in one development of the invention, a brake valve device is associated with the return side of the consumer, it is particularly advantageous if the short circuit device is located downstream of the brake valve device. As a result of this arrangement, the regeneration function can be combined in a simple manner with a load-holding function or a brake valve function.

To protect the return side of the consumer, it is advantageous to provide a pressure limiting device located upstream of the brake valve device. As a result of which, it is possible to protect the return side of the consumer in a simple manner.

It is particularly advantageous if the consumer is a stick cylinder of an excavator. With the regeneration function of the invention, it is possible with little construction effort and expense and low line losses to achieve a regeneration function on a stick cylinder to increase the speed of movement of the stick cylinder and thus of the stick of the excavator. It is also possible to prevent cavitation on the admission side of the stick cylinder. As a result of the overriding of the regeneration function by the admission pressure of the stick cylinder, under operating conditions in which a high admission pressure is necessary to achieve high digging forces, it becomes possible to deactivate the regeneration function in a simple manner.

BRIEF DESCRIPTION OF THE DRAWING

Additional advantages and features of the invention are explained in greater detail below on the basis of the exemplary embodiment illustrated in the accompanying schematic figure that shows a schematic diagram of a control valve device incorporating features of the invention.

DESCRIPTION OF THE PREFERRED EMBODIMENT

The figure shows a schematic diagram of a control valve device 1 of the invention for the control of a dual-action consumer 2, for example of a stick cylinder that activates a stick of an excavator.

The control valve device 1 comprises a control valve 3 connected to a delivery line 4 of a pump (which is not shown in any further detail) and to a reservoir line 5 that leads to a reservoir that is likewise not shown in any further detail.

The control valve 3 is also connected to a first pressure fluid line 6*a* which is connected with a piston-side compression chamber 7*a* of the consumer 2 and to a second pressure fluid line 6*b* which is connected with a compression chamber 7*b* on the piston-rod side of the consumer 2.

In the illustrated neutral position 3*a* of the control valve 3, the pressure fluid lines 6*a*, 6*b*, the delivery line 4, and the reservoir line 5 are shut off. In a normal position 3*b*, the delivery line 4 is connected with the first pressure fluid line 6*a* and the pressure fluid line 6*b* with the reservoir line 5. In the normal position 3*b*, the compression chamber 7*a* therefore forms the admission side of the consumer 2 and the piston-rod side compression chamber 7*b* of the consumer 2 forms the return side of the consumer 2. In an additional position 3*c* of the control valve 3, the delivery line 4 is connected with the second pressure fluid line 6*b* and the first pressure fluid line 6*a* is connected with the reservoir line 5. In the position 3*c*, the piston-rod-side compression chamber 7*b* of the consumer 2 forms the admission side and the piston-side compression chamber 6*a* forms the return side of the consumer 2.

The invention teaches that the control valve device 1 is provided with a regeneration function which, under operating conditions in which the piston-side compression chamber 7*a* of the consumer 2 forms the admission side and the piston-rod-side compression chamber 7*b* forms the return side of the consumer 2, makes it possible to connect the return side with the admission side.

The regeneration function comprises a short circuit device 10 located between the control valve 3 and the consumer 2. The short circuit device 10 is provided with a shutoff position and an open position, and is located in a hydraulic fluid line 12 that connects the first pressure fluid line 6*a* with the second pressure fluid line 6*b*. In the illustrated embodiment, the short circuit device 10 includes a short circuit valve 11 in the form of a seat valve that opens toward the first pressure fluid line 6*a* and is realized in the form of a spring-loaded check valve.

For the regeneration function, the control valve 3 is provided with a regeneration position 3*d*, in which the delivery line 4 is connected with the first pressure fluid line 6*a* that forms the admission side of the consumer 2. The second pressure fluid line 6*b* that forms the discharge side of the consumer 2 is shut off.

The control valve 3 is realized in the form of a control valve that exerts a throttling action in intermediate positions and is actuated into the neutral position 3*a* by means of springs 15*a*, 15*b*. The control valve 3 is actuated toward the normal position 3*b* and the regeneration position 3*d* by a control signal that is transmitted in a control line 16*a*, for example a hydraulic control pressure line. The control valve 3 is actuated toward the additional position 3*c* by an additional control signal, for example an additional control pressure which is transmitted in a control line 16*b*.

The short-circuit valve 11 can be actuated into the open position by the control signal that actuates the control valve 3 toward the normal position 3*b* and the regeneration position 3*d*. For this purpose, connected to the control line 16*a* is a branch line 17 that leads toward the control surface of the short circuit valve 11 that acts toward the open position.

The regeneration function can be overridden as a function of the admission pressure that is available on the admission side of the consumer. For this purpose, a control line 18 branches off from the first pressure fluid line 6*a* that forms the admission side. The control line 18 is connected to a control surface of the control valve 3 that counteracts the control signal 16*a*, and actuates the control valve 3 toward the neutral position 3*a*.

To protect the consumer, a pressure limiting device 19*a* is associated with the first pressure fluid line 6*a* and a pressure limiting device 19*b* is associated with the second pressure fluid line 6*b*.

A brake valve device 20 is located in the second pressure fluid line 6*b*. The pressure limiting device 19*b* is connected to the second pressure fluid line 6*b* upstream of the brake valve device 20. The short circuit device 10 is connected to the second pressure fluid line 6*b* downstream of the brake valve device 20.

The short circuit device 10, together with the brake valve device 20 and the pressure limiting device 19*b*, is located in a valve module 21. The valve module 21 is located directly on the consumer 2, for example on the piston-rod-side compression chamber 7*b* that forms the return side.

When the control valve 3 is actuated in response to the control signal present in the control line 16*a*, the control valve 3 is actuated toward the normal position 3*b* in which the first pressure fluid line 6*a* is connected with the delivery line 4 of the pump and, thus, forms the admission side of the consumer 2. In the normal position 3*b*, the second pressure fluid line 6*b* is in communication with the reservoir line 5 and, thus, forms the return side of the consumer 2.

When there is a further increase of the control signal in the control line 16*a*, the control valve 3 is actuated toward the regeneration position 3*d*, in which the second pressure fluid line 6*b* that forms the return side is shut off. The control signal that actuates the control valve 3 toward the regeneration position 3*d* also actuates the short circuit valve 11 into the open position via the branch line 17.

For the regeneration function, the pressure fluid can thus flow out of the return side of the consumer into the second pressure fluid line 6*b* (whereby the second pressure fluid line 6*b* is shut off by the control valve 3, which is switched into the regeneration position 3*d*) via the pressure fluid line 12 and the short circuit valve 11 (which is switched into the open position by the control signal) into the first pressure fluid line 6*a* that forms the admission side of the consumer 2. As a result of which, on the admission side of the consumer 2, in addition to the delivery flow supplied by the pump, the flow of pressure fluid flowing out on the return side is also available to achieve an increased speed of movement of the consumer and to prevent cavitation on the admission side of the consumer. As a result of the location of the short circuit device 10 directly on the consumer 2 or between the consumer 2 and the control valve 3, short flow paths are achieved which result in low line losses and require little construction effort and expense. All that is necessary on the control valve 3 is a regeneration position 3*d*, by means of which the return side of the consumer 2 can be shut off for the regeneration function.

The regeneration function can be overridden as a function of the admission pressure that is available at the admission side of the consumer. For this purpose, the control valve 3 is actuated by means of the control line 18, which is connected to the first pressure fluid line 6*a* that forms the admission side, by the admission pressure in opposition to the control signal that is transmitted in the control line 16*a* toward the position 3*b*, in which the second pressure fluid line 6*b* that forms the return side is connected to the reservoir line 5. Simultaneously, the short circuit valve 11 is actuated into the shutoff position by the admission pressure that is available in the first pressure fluid line 6*a*. The regeneration function can thereby be overridden and thus deactivated under operating conditions in which high admission pressures are necessary on the admission side of the consumer 2, for example when high digging forces are necessary on the stick of an excavator that is being activated by the consumer.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A control valve device for the control of a dual-action consumer, comprising:

a control valve that controls a connection of an admission side of a consumer with a pump and a return side of the consumer with a reservoir;

a regeneration function by means of which the return side of the consumer is selectively connected with the admission side of the consumer, wherein the regeneration function comprises a short circuit device located between the consumer and the control valve and makes possible a connection of the return side of the consumer with the admission side of the consumer, wherein the connection of the return side of the consumer with the reservoir is selectively blocked by the control valve for the regeneration function; and a brake valve device associated with the return side of the consumer, wherein the short circuit device is located between the brake valve device and the control valve.

2. The control valve device of claim 1, wherein the control valve includes a regeneration position in which the admission side of the consumer is in connection with the pump and the connection of the return side of the consumer with the reservoir is shut off.

3. The control valve device of claim 2, wherein the control valve is selectively actuated by a control signal toward a normal position that connects the admission side of the consumer with the pump and the return side of the consumer with the reservoir, and wherein the control valve is selectively actuated by an increasing control signal from the normal position toward the regeneration position.

4. The control valve device of claim 1, wherein the short circuit device comprises a short circuit valve having a shutoff position and an open position, and is selectively actuated into the open position for the regeneration function.

5. The control valve device of claim 4, wherein for the regeneration function, the short circuit valve is selectively actuated into the open position by the control signal that actuates the control valve toward a regeneration position.

6. The control valve device of claim 1, wherein connected to the control valve is a first pressure fluid line that is in communication with the admission side of the consumer, and a second pressure fluid line that is in communication with the return side of the consumer, and wherein the short circuit device is located in a pressure fluid line that connects the first pressure fluid line with the second pressure fluid line.

7. The control valve device of claim 1, wherein the short circuit device is located on the consumer.

8. The control valve device of claim 1, wherein to protect the return side of the consumer, a pressure limiting device is located between the brake valve device and the consumer.

9. The control valve device of claim 1, wherein the consumer is a stick cylinder of an excavator.

10. A control valve device for the control of a dual-action consumer, comprising:

a control valve that controls a connection of an admission side of a consumer with a pump and a return side of the consumer with a reservoir; and a regeneration function by means of which the return side of the consumer is selectively connected with the admission side of the consumer, wherein the regeneration function comprises a short circuit device located between the consumer and the control valve and makes possible a connection of the return side of the consumer with the admission side of the consumer, wherein the connection of the return side of the consumer with the reservoir is selectively blocked by the control valve for the regeneration function, wherein the short circuit device comprises a short circuit valve having a shutoff position and an open position and is selectively actuated into the open position for the regeneration function, and wherein the short circuit valve comprises a seat valve that opens toward the admission side of the consumer.

11. The control valve device of claim 10, wherein the seat valve comprises a spring-loaded check valve which is selectively actuated into the open position by the control signal that actuates the control valve toward the regeneration position.

12. The control valve device of claim 11, wherein the regeneration function is selectively overridden as a function of the admission pressure that is available on the admission side of the consumer.

13. The control valve device of claim 12, wherein the control valve is selectively actuated from the regeneration position toward the normal position by an admission pressure that is available on the admission side of the consumer.

14. The control valve device of claim 13, wherein the control valve includes a control surface that counteracts the control signal and is in communication with the admission side of the consumer.

15. The control valve device of claim 13, wherein the control signal that actuates the control valve is selectively reduced as a function of the admission pressure.

* * * * *